United States Patent [19]

Lindberg

[11] 3,945,481

[45] Mar. 23, 1976

[54] RESILIENTLY MOUNTED DRIVE NUT AND CARRIAGE ASSEMBLY

[75] Inventor: Arthur F. Lindberg, Chicago, Ill.

[73] Assignee: Teletype Corporation, Skokie, Ill.

[22] Filed: May 8, 1974

[21] Appl. No.: 468,047

[52] U.S. Cl. ..... 197/90; 197/82; 74/424.8 R

[51] Int. Cl.[2] ..... B41J 19/00

[58] Field of Search ..... 197/82, 84 R, 84 A, 84 B, 197/89, 90; 74/89.15, 122, 424.8 R, 424.8 A, 424.8 B, 424.8 C, 424.8 VA, 424.8 VZ, 424.8 NA, 441, 459

[56] References Cited

UNITED STATES PATENTS

| | | | |
|---|---|---|---|
| 2,449,855 | 9/1948 | Marholz | 74/441 |
| 2,464,873 | 3/1949 | Lear | 74/424.8 R |
| 2,504,018 | 4/1950 | Gibson et al. | 74/424.8 R UX |
| 2,567,483 | 9/1951 | Hotine | 74/441 |
| 2,578,771 | 12/1951 | Zint | 197/82 |
| 2,594,443 | 4/1952 | Johnston | 74/424.8 R X |
| 2,876,653 | 3/1959 | Meyer | 74/424.8 R |
| 2,924,112 | 2/1960 | Martens | 74/424.8 R |
| 2,982,145 | 5/1961 | Orner | 74/424.8 R |
| 3,225,886 | 12/1965 | Cetran et al. | 197/84 R |
| 3,318,431 | 5/1967 | Lapointe et al. | 197/90 |
| 3,628,645 | 12/1971 | McFeaters et al. | 197/90 |
| 3,656,358 | 4/1972 | Kopp | 74/89.15 |
| 3,698,257 | 10/1972 | Ballentine et al. | 74/424.8 R |
| 3,715,021 | 2/1973 | Caspari | 197/82 |
| 3,831,460 | 8/1974 | Linley | 74/459 |
| 3,835,976 | 9/1974 | Behrens et al. | 197/82 |

*Primary Examiner*—Edgar S. Burr
*Assistant Examiner*—B. T. Rader
*Attorney, Agent, or Firm*—K. R. Bergum; J. D. Kaufmann; J. L. Landis

[57] ABSTRACT

A specially constructed drive nut with both threaded and unthreaded axial bores, and a unique resilient mounting assembly therefor, are employed to couple a rotationally driven lead screw to a linearly driven carriage. The mounting assembly includes a specially constructed resilient O-ring which is coaxially positioned on the drive nut near the unthreaded end thereof and, in combination with a pair of adjustable O-ring clamping plates, resiliently mounts the drive nut in a cantilevered manner on an apertured carriage side wall through which the lead screw passes. As constructed and mounted, the drive nut is allowed to become slightly skewed relative to the axis of the lead screw, if required, in order to minimize frictional forces which can develop, for example, because of tolerance variations, bow in the lead screw, or axial misalignment of the latter with the carriage guide rods. By properly selecting the material for the O-ring, any kinetic energy-imparted bounce forces of the carriage may also be substantially, if not completely, absorbed and dissipated in the form of heat.

In an alternative drive nut embodiment, the wall of the threaded portion thereof is segmented so as to form a plurality of resilient, internally threaded fingers for minimizing backlash.

15 Claims, 7 Drawing Figures

RESILIENTLY MOUNTED DRIVE NUT AND CARRIAGE ASSEMBLY

BACKGROUND OF THE INVENTION

1. Field Of The Invention

The present invention relates to printer apparatus and, more particularly, to a lead screw driven, resiliently mounted drive nut and carriage assembly therefor.

2. Description Of The Prior Art

In lead screw driven printers, a print head is normally mounted on a suitable carriage which is driven reciprocally across the width dimension of a web, such as paper in roll stock form, or any other suitable record medium on which printing is to take place. The web is typically drawn over a rotatable platen with either frictional engagement with the latter or engagement with an associated sprocket wheel employed to effect controlled line feed advancement of the web.

The carriage is normally driven along a pair of guide rods aligned in parallel relationship with the lead screw. The carriage (and print head mounted thereon) is coupled to the lead screw by a threaded member, usually in the form of a drive nut.

With the lead screw normally driven by a reversible stepping motor, for example, the rotational displacement of the lead screw is translated through the drive nut into linear reciprocal displacement of the carriage (and print head). The direction in which the carriage is driven, and the speed of travel thereof, of course, is directly dependent on the direction and speed of rotation of the lead screw.

Such lead screw driven carriages are often employed in high speed printers, particularly of the dot matrix type. One such illustrative printer is disclosed in a commonly assigned and concurrently filed copending application of J. L. DeBoo-E. C. Feldy-H. S. Grear, Ser. No. 468,046, herein incorporated by reference.

While a power driven lead screw affords a number of advantages over belts or chains for driving carriage-mounted print heads in terms of simplicity, ruggedness, cost and maximum possible driving speed, they nevertheless have presented a number of troublesome problems heretofore. Specifically, because of the necessity of threads, unless stringent tolerances are adhered to in the manufacture of the lead screw and drive nut, there must normally be either some backlash allowed for therebetween, or a resilient drive nut employed in order to minimize the possibility of excessive frictional forces being established.

Attempts to go the route of manufacturing the lead screw and drive nut with stringent tolerances has proven to be impractical in practice for a number of reasons. First, the lead screw must necessarily extend across the entire width dimension of the printer, i.e., in parallel relationship with the platen and, as such, there is a tendency for the lead screw to inherently have or develop a slight bow which is most pronounced along the intermediate region thereof. Secondly, while the lead screw is normally mounted on precision ball bearings (or bushings), tolerance variations in the bearing mountings, as manufactured, or as positioned on supporting frame structure of the printer, invariably leads to slight, but normally troublesome misalignment between the lead screw and carriage guide rods. Thirdly, because of the size of the threads and the axial length of the lead screw, a precision machining operation, as distinguished from a conventional and simple cold rolling operation, to form the threads would prove prohibitive from a cost standpoint.

Accordingly, even if a conventional drive nut could be manufactured to threadably engage the lead screw in a very close fitting manner with negligible backlash, very high frictional forces would normally still develop not only between the lead screw and drive nut, but also between the lead screw and carriage guide rods. Such frictional forces would lead to excessive wear of the mating parts generating them, and could possibly overcome the driving torque of the stepping motor. In the latter case, the carriage would actually bind or lock-up on the guide rods. Such a condition, of course, could very possibly also seriously damage the stepping motor in many printers.

Equally important, however, is the fact that any non-uniform frictional forces, whether great enough to actually bind the carriage or not, would necessarily at least alter the speed at which the carriage is either continuously driven or stepped along the guide rods. Such unintended variations in carriage speed during printing cannot be tolerated, as there must be a very precisely correlated relationship between the firing of the print wires (or hammers) and the lateral position of the print head at each successive dot position along a given print line.

In an attempt to solve some of the foregoing problems, specially constructed, elongated drive nuts have been proposed and/or used heretofore wherein the central bore has been threaded along its entire axial length, but with one end region thereof formed with a circumferentially spaced array of either radially and longitudinally extending slits, or radially and spirally extending slits, so as to produce a plurality of internally threaded resilient fingers (or segments). One or more so-called garter springs have normally been coaxially mounted on such fingers so as to augment the inherent spring-biased compressive forces of the resilient fingers which maintain the latter in continuous contact with the threads of the lead screw.

In still another prior alternative design, an elongated drive nut has been formed with an intermediate section having a thin wall, with a circumferential array of longitudinally disposed slits formed therein, as well as in a front end section that is slightly tapered. This allows a variable degree of expansion of the drive nut body over an appreciable portion of the axial length thereof.

In all of such prior drive nut designs, the central bore, as previously mentioned, has been threaded along its entire axial length. As such, while prior drive nut versions may have a resilient section to minimize backlash by presenting a continuous "load" on the lead screw, the end-to-end internally threaded bore prevents the drive nut from being slightly tilted or skewed relative to the axis of the lead screw. Such movement is often desired in order to compensate for any bow in the lead screw, as well as for any misalignment thereof relative to the carriage guide rods.

Another approach to the problem of minimizing excessive or detrimental frictional forces between a drive nut and lead screw has been to purposely build-in a predetermined degree of backlash therebetween. It is appreciated from the foregoing, of course, that in such a case the drive nut would normally not be constructed with a segmented resilient section, as such a section is intended and employed to minimize backlash. Accordingly, prior backlash producing drive nuts have each typically taken the form of a conventional elongated, solid wall, tubular member with a threaded bore extending along the entire axial length thereof. Such a construction, however, even with loose tolerances, prevents any appreciable tilting or skewing of the drive nut relative to the axis of the lead screw.

An equally important problem that arises when a built-in degree of backlash is employed in a lead screw-drive nut assembly is the fact that a substantial degree of kinetic energy is necessarily established by the mass of the coupled carriage, together with any associated apparatus carried thereby, such as a print head. Such kinetic energy can establish substantially large, initial impact forces, as well as transient forces, between the lead screw and drive nut threads if not compensated for or absorbed in some way. These detrimental forces, of course, lead to a "bouncing" condition of the carriage (and print head) which has proven to be particularly troublesome in lead screw driven printers where the carriage is stepped from one character print column position to the next across the width of the platen.

The potential severity of force-induced bouncing of a stepped carriage resides in the fact that if all of the kinetic energy imparted by the drive nut-carriage assembly to the lead screw is not absorbed completely as it is established, there will be increased wear of the mating lead screw-drive nut threads, and the desired speed of travel of the carriage may be adversely affected.

Considered another way, the kinetic energy induced forces ideally should be absorbed at a rate which is equatable to the change in velocity of the drive nut-carriage assembly. Unfortunately, prior drive nuts have not been able to inherently, or as mounted on or coupled to the carriage, compensate for kinetic energy induced bounce forces, particularly in a stepped carriage mode of printer operation.

SUMMARY OF THE INVENTION

It, therefore, is an object of the present invention to provide new and improved lead screw driven drive nuts, and resilient mounting assemblies therefor, to couple the lead screw to a linearly driven carriage in a manner that minimizes kinetic energy-imparted bounce forces, and compensates for any tolerance variations and/or bow in the lead screw, and for any lead screw-carriage guide rod misalignment, so as to prevent the establishment of detrimental frictional forces.

In accordance with the principles of the present invention, the above and other objects are realized in one preferred illustrative embodiment wherein a specially constructed lead screw-driven nut has a first threaded bore extending axially along approximately one-half of its axial length, and a second unthreaded and aligned bore of larger diameter extending along the remaining half of the drive nut. As such, an annular clearance space is established between the wall of the unthreaded bore and an associated lead screw passing therethrough, which space allows the drive nut to acquire a slightly tilted position, if required, relative to the axis of the lead screw.

Also in accordance with the principles of the present invention, a resilient mounting assembly for the drive nut includes a specially constructed resilient O-ring which is coaxially positioned on the drive nut near the unthreaded end thereof and, in combination with a pair of adjustable O-ring clamping plates, resiliently mounts the drive nut in a cantilevered manner on an apertured side wall of the carriage through which the lead screw passes. The controllable compressive force exerted by the clamping plates on the O-ring is advantageously employed to not only secure the latter to the carriage side wall, but at least, in part, determine the degree of resiliency exhibited by the O-ring.

With the drive nut thus constructed and mounted on the carriage through the resiliently clamped O-ring, it may be slightly skewed or tilted relative to the axis of the lead screw, while still minimizing any relative axial and/or radial displacement therebetween. With the drive nut threads additionally dimensioned so as to establish a predetermined degree of backlash when threadedly mounted on the lead screw, it is seen that the drive nut-carriage assembly can readily compensate for not only tolerance variations in the lead screw threads, but for any bow therein, as well as any misalignment in parallelism between the lead screw and the guide rods of the carriage. As such, frictional forces are substantially minimized between all mating surface areas wherein there is relative movement in the composite lead screw-drive nut-carriage assembly. This, in turn, of course, advantageously minimizes wear and prevents the carriage from binding or the speed of travel thereof to be impaired.

Such advantageous end results, without any backlash being required, are also realized with an alternative embodiment of the drive nut, wherein the threaded end is segmented to form a plurality of resilient fingers which, with or without coaxially mounted compression springs, maintain continuous, but resilient, contact with the threads of the lead screw.

In accordance with another aspect of the invention, by making the O-ring out of a viscoelastic material, such as a polyester base urethane, any kinetic energy imparted bounce forces that are established by the carriage due to backlash (whether predetermined or otherwise) are substantially, if not completely, absorbed by the O-ring, and dissipated thereby in the form of heat. Significantly, such an O-ring is capable of absorbing kinetic energy immediately as it develops, so that no multiple force-induced form of carriage bouncing can develop. As previously mentioned, this is particularly important in a lead screw driven carriage that is stepped along an extended path.

DETAILED DESCRIPTION OF THE INVENTION

Figures 1, 7:
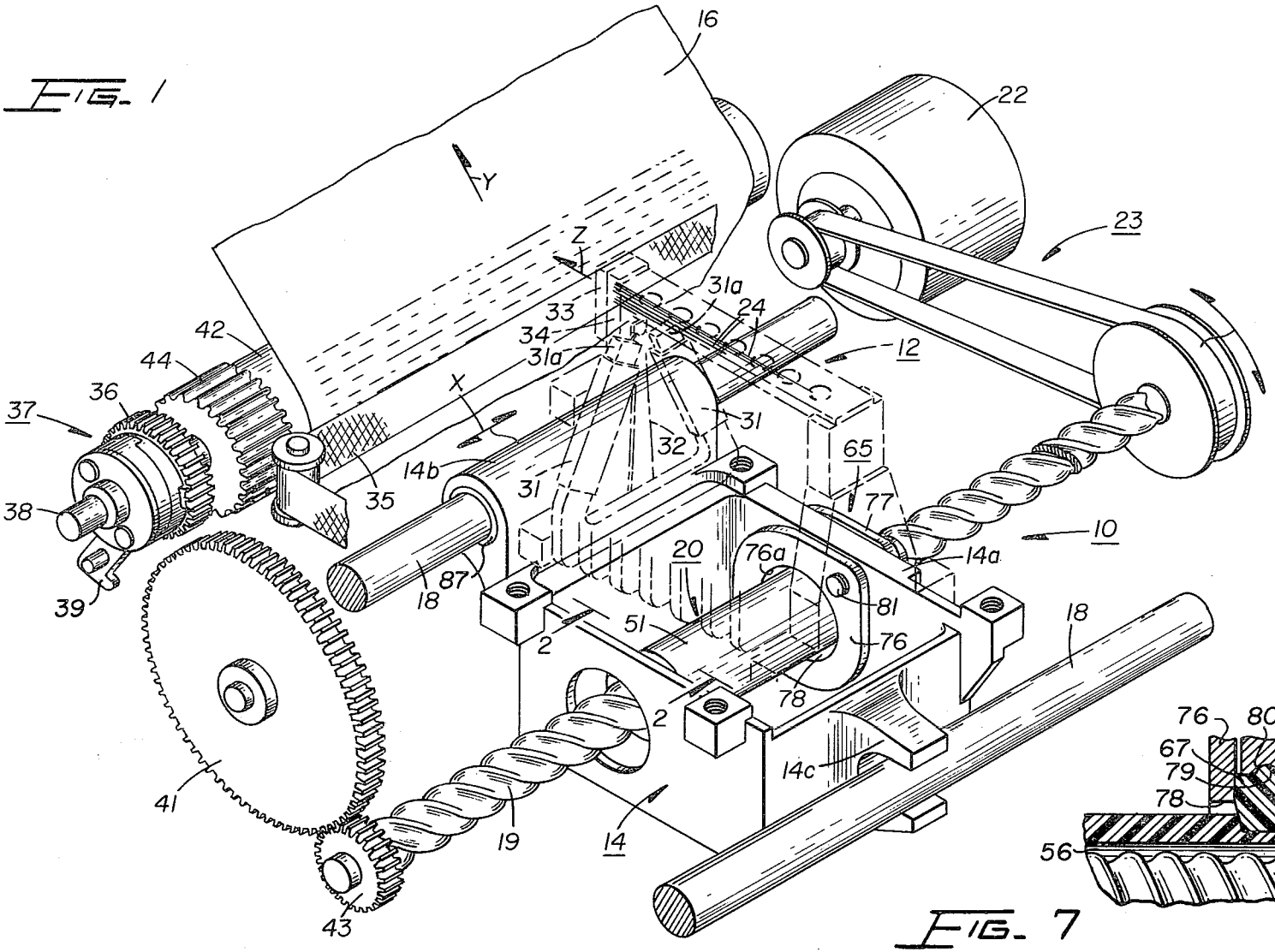
FIG. 1 is a partially broken away perspective view of an illustrative high speed dot matrix printer, with some parts being omitted for the purpose of illustrating a unique, resiliently mounted drive nut and carriage assembly incorporated therein and embodying the principles of the present invention.
FIG. 7 is an alternative of the drive nut and mounting shown in FIG. 3.

As mentioned hereinabove, the unique drive nuts and resilient mountings therefor as embodied herein have universal application with respect to lead screw driven apparatus, but for purposes of illustration, they are disclosed herein in connection with a high speed dot matrix printer 10 of the type depicted generally in FIG. 1.

Such a printer 10 is of the class wherein a print head 12, shown only in phantom outline form, is mounted on a carriage 14 for lateral reciprocal movement in a horizontal direction (X) in front of and across the width dimension of a web 16, such as paper in roll stock form, or any other suitable record medium on which printing is to take place. It should be appreciated that the carriage 14 and the print head 12 mounted thereon may be either stepped to each successive print column position during the printing of a given line, or be driven at a constant speed therealong, with the return of the carriage 14 and print head 12 to the "home" position being accomplished at a preferably faster constant or continuously accelerating rate of speed.

The carriage 14 is driven along a pair of guide rods 18—18 by means of a rotatably driven lead screw 19 which is coupled to the carriage 14 by means of a specially constructed and mounted drive nut 20 embodying the principles of the present invention. Actually two embodiments of the drive nut 20, as well as two carriage-supported resilient mountings applicable for use with either drive nut 20, will be described in detail hereinafter.

The lead screw 19 is suitably journalled at opposite ends in frame structure (not shown) for rotation, and is reversibly driven by a power source 22, such as a stepping motor, through a suitable drive train which, as depicted, comprises a belt-pulley assembly 23.

In the present illustrative printer embodiment, the print head 12 includes a vertical column of seven selectively actuable print wires 24, shown only in fragmentary form, for use in printing 5 × 7 dot matrix characters (or nine similarly oriented wires for 5 × 9 dot matrix characters). The print wires 24 may be selectively actuated by respectively associated electromagnetic actuator assemblies, for example, with only the first of seven being shown in phantom outline form and identified by the numeral 31 in FIG. 1. These assemblies 31 are arranged in a compact, horizontally spaced and vertically stepped array so as to correspondingly position the essentially horizontally disposed print wires 24 in a stepped and vertically stacked array as shown in FIG. 1.

Each actuator assembly 31 includes an associated one of a corresponding number of vertically extending and pivotally mounted flat spring armatures 32, only the first one nearest the paper 16 being shown in phantom in FIG. 1. Each of the print wires 24 is connected to the upper end of a different one of the armatures 32 in such a manner that each armature 32, when magnetically drawn backward against a pair of core pole faces 31a of the associated actuator assembly 31, retracts the print end of the attached wire within a multibored guide block 33, supported on a face plate 34. Thereafter, upon the selectively and logically controlled release of each magnetically held armature 32, the spring biased force thereof will "fire" the print wire 24 connected to the upper end thereof in the designated (Z) direction.

As a result, each "fired" wire 24 is propelled against a discrete area of an inked ribbon 35, with the latter then being driven against the paper 16 so as to effect the imprinting of a particular dot of a given dot matrix character on the paper 16. To effect such dot matrix character printing, it is obvious that the print wires 24 must be fired in a specific sequence for each character to be printed. For a more detailed description of one preferred embodiment of the dot matrix print head 12 which has been only generally described hereinabove, as well as of suitable operating control circuitry for actuating the print wires 24, none of which is critical or important with respect to an understanding of the present resiliently mounted drive nut assemblies, reference is again made to the aforementioned copending application of J. L. DeBoo et al.

With respect to a typical mode of operation of the printer 10, it is readily apparent that after the carriage mounted print head 12 has been either stepped or continuously driven to the right in the (X) direction, as viewed in FIG. 1, so as to effect the printing of a desired number of dot matrix characters along a given print line, the carriage 14 is rapidly returned to the home position. At that time a line feed takes place, i.e., the paper 16 is stepped or advanced one or more line printing spaces in the (Y) direction in preparation for printing a new line of character information.

To effect such line feeding, a rotatable platen gear 36, comprising part of a line feed mechanism 37 (shown only generally in FIG. 1), is eccentrically displaced relative to a platen support shaft 38, by a pivotally actuated lever 39, so as to engage an intermediate gear 41 and, thereby, effect the coupling of a platen 42 to a lead screw gear 43. In this manner, the platen 42 can be rotated to effect line feeding whenever the lead screw 19 is rotated, and independently of the position of the carriage mounted print head 12. For a more detailed description of one preferred line feed mechanism of the type generally shown herein for effecting both single and multiple line feeding independently of carriage position, and with automated detent lever release of a platen-associated ratchet wheel 44, so as to effect very quiet multiple line feeding, reference is made to another commonly assigned and concurrently filed copending application of I. B. Hodne, Ser. No. 468,048, also herein incorporated by reference.

RESILIENTLY MOUNTED DRIVE NUT AND CARRIAGE ASSEMBLY

With the foregoing general description of one typical dot matrix printer 10 as background, attention will now be directed to a new and improved drive nut 20, and a carriage-supported resilient mounting 65 therefor, both of which are particularly adapted for use in the printer 10 of FIG. 1. An alternative drive nut embodiment 90, and an alternative resilient mounting 65' applicable to either drive nut 20, 90, will also be described in detail hereinafter.

Figures 2, 3, 4, 5, 6:
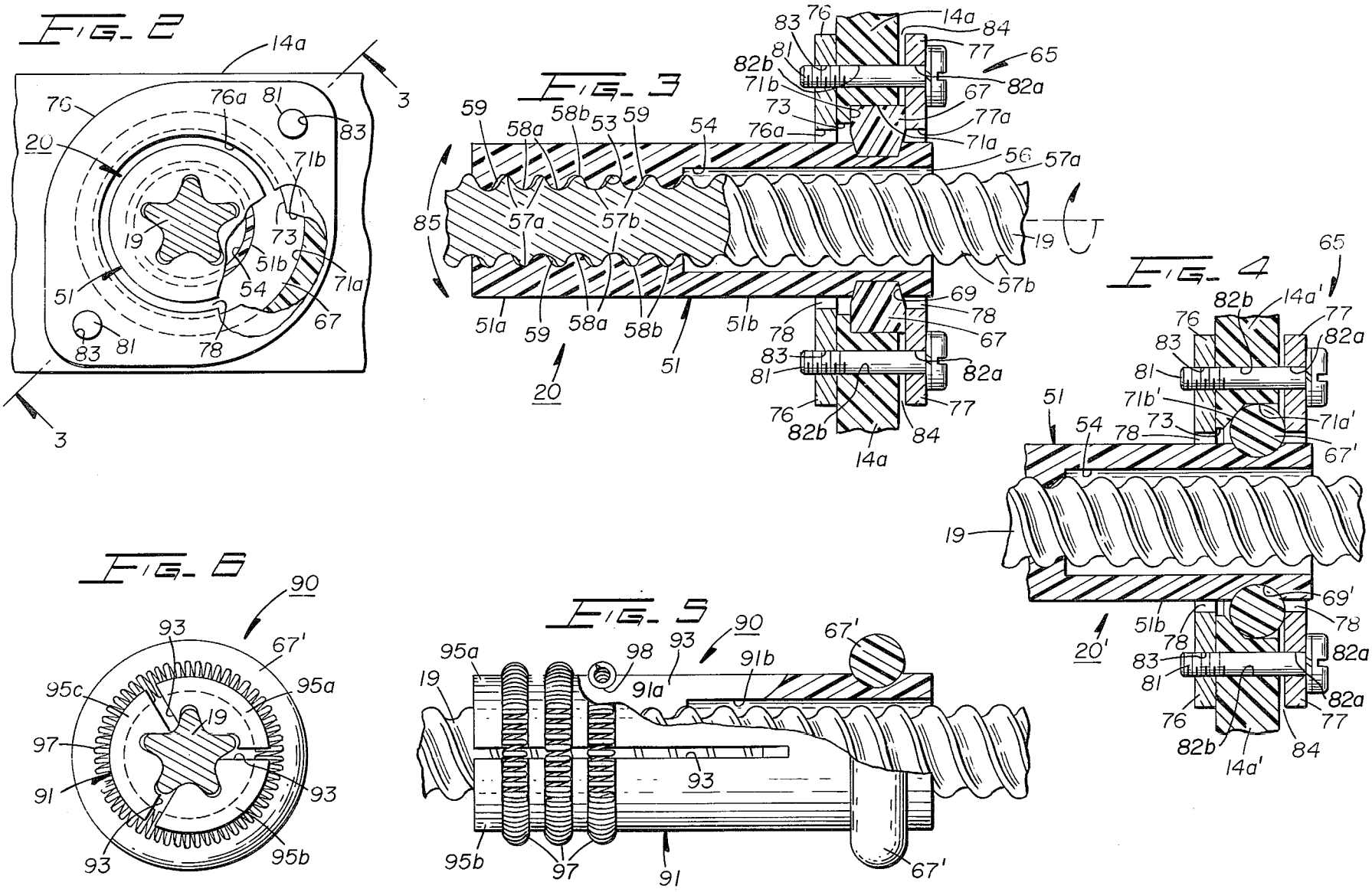
FIG. 2 is an enlarged end view, partially in cross-section, taken along the line 2—2 of FIG. 1, showing one preferred drive nut and one of two carriage supported clamping plates employed to resiliently mount the drive nut on a carriage sidewall so as to produce minimal frictional threaded engagement of the drive nut with a lead screw.
FIG. 3 is an enlarged, fragmentary, cross-sectional detail view, taken longitudinally along the line 3—3 of FIG. 2, showing details of one of the preferred drive nuts and carriage supported resilient mountings therefor, with the mounting including an O-ring of essentially trapezoidal cross-section.
FIG. 4 is an enlarged longitudinal, fragmentary, cross-sectional detail view similar to that of FIG. 3, but modified to accommodate a coupling O-ring of circular cross-section.
FIG. 5 is an enlarged, side elevational detail view, partially broken away, illustrating an alternative drive nut construction incorporating a resilient, segmented portion with an internally threaded bore.
FIG. 6 is an end view of the drive nut of FIG. 5, with the lead screw being shown in cross-section.

With reference first to FIGS. 2 and 3, it is seen that the drive nut 20, shown only generally in the printer 10 of FIG. 1, is formed with an elongated, cylindrical body 51, one portion 51*a* thereof having an axially threaded bore 53 that extends inwardly from one end to about the middle of the drive nut body 51. The other half or portion 51*b* of the body 51 is formed with an axially disposed unthreaded bore 54. The latter bore 54 is formed with a diameter sufficient to provide an appreciable annular space 56 between the crest of the teeth in the lead screw 19 and the inner wall of the bore 54. As will presently be seen, such an oversized, non-threaded counterbore 54 allows the drive nut to be displaced into a slightly skewed or tilted position relative to the axis of the lead screw 19, as may be required to compensate not only for any inherent bow in the lead screw 19, but for any misalignment of the axis of the latter relative to the axes of the carriage guide rods 18, for example.

Considering the lead screw-drive nut assembly 19, 20 of FIGS. 2 and 3 more particularly, the lead screw 19 is of the type having a plurality of helically disposed threads 57*a*–57*b* formed in the periphery thereof, such as by a conventional rolling process. All of the threads 57*a*–57*b* (five being shown in the cross-sectional view of FIG. 2) are formed with the same helical pitch, and are defined by outwardly tapered and spiraled teeth 57*a* which are formed between adjacent spiraled grooves 57*b*. The crest of the teeth 57*a* and the root of the grooves 57*b* may be formed with either rounded (as shown), flat or V-shaped profiles as desired for a particular application. The internal threads 58*a*–58*b* formed in the drive nut section 51*a*, comprised of spiraled teeth 58*a* and grooves 58*b*, of course, are likewise dimensioned and disposed with the same longitudinally extending helix angle as the threads 57*a*–57*b* formed in the lead screw 19.

With the drive nut 20 mounted on and threadably coupled to the lead screw 19, rotation of the latter in a counterclockwise direction, as depicted by the arrow about the axis in FIG. 3, for example, will result in the non-rotatably mounted drive nut 20 being driven linearly to the right. During such translational linear movement of the drive nut 20 the leading (as viewed from left to right in FIG. 3) side wall of each tooth 57*a* of the lead screw 19, will exert a relatively high bearing force against the mating and trailing side wall of each respectively associated tooth 58*a* formed in the drive nut 20. As such, a relatively small diameter lead screw 19 and drive nut 20 may be employed to move or drive a relatively heavy load.

However, if any additional and undesired frictional forces should develop between the lead screw 19 and drive nut 20, they can readily lead to excessive wear of the mating bearing surfaces of the threads that gave rise to such forces, and to a possible binding or jamming condition of the drive nut-carriage assembly. Such undesired forces, if not eliminated or compensated for, can develop because of any one of a number of different structural conditions that may exist, such as loose tolerance variations in the mating threads 57*a*–57*b* and 58*a*–58*b*, or bow in the lead screw 19, or lead screw 19 carriage guide rod 18 misalignment.

In accordance with the principles of the present invention, and in one preferred printer application, the threads in the drive nut body section 51*a* are purposely dimensioned so as to produce a predetermined space, identified by the numeral 59 (FIG. 3), between the trailing side walls of the teeth 57*a* in the lead screw 19 and the leading side walls of the teeth 58*a* in the drive nut 20. This, of course, establishes a predetermined degree of backlash, preferably of the order of 0.003 to 0.02 inches, between the drive nut 20 and lead screw 19. With such deliberately established backlash, adverse effects from tolerance variations are not only minimized, but the short, threaded section 51*a* of the nut 20 is rendered more conducive to being slightly displaced angularly away from the axis of the lead screw 19.

However, in order for the drive nut 20 to acquire such a slightly skewed or tilted position, it must necessarily also be resiliently mounted. With respect to mounting, as the drive nut 20 is employed to accurately translate rotational movement of the lead screw 19 into linear movement of the carriage 14 (and print head 12 mounted thereon), it is obviously very important that relative axial and radial displacement not only between the lead screw 19 and drive nut 20 (other than based on predetermined backlash), but between the drive nut 20 and carriage 14 be minimized.

These simultaneous requirements are satisfied in one preferred drive nut-carriage assembly by utilizing a specially configured and resilient mounting assembly designated generally by the reference numeral 65 in FIG. 3. As disclosed therein, the assembly includes a resilient O-ring 67 as the main coupling member, which may be made of rubber or plastic material, for example, and in one preferred form has a trapezoidal cross-section. An inner annular portion of the O-ring 67, having inwardly tapered side walls, is partially seated within a mating peripheral groove 69 of similar configuration formed near the unthreaded end portion 51*b* of the drive nut body 51.

An outer annular portion of the resilient O-ring 67 is partially seated within an undercut groove 71*a*–71*b* having a base 71*a* and a side shoulder 71*b* formed in the peripheral edge of an aperture 73 formed in the side wall 14*a* of the carriage 14 (best seen in FIG. 3). As illustrated, it is seen that the undercut groove is exposed to the outer surface of the side wall 14*a*. This allows the O-ring 67, when partially seated within the groove, to protrude outwardly a short distance from the outer surface of the side wall 14*a*.

The O-ring 67 is employed to firmly, but resiliently, couple the drive nut 20 to the carriage side wall 14*a* by means of two O-ring clamping plates 76, 77, each having a respective over-sized central aperture 76*a*, 77*a* formed therein. An annular gap 78 is thus formed between the respective peripheral edges of the clamping plate apertures 76*a*, 77*a* and the outer wall of the portion 51*b* of the drive nut body 51.

The clamping plates 76 and 77 hold mating portions of the carriage side wall 14*a* and O-ring 67 under compression therebetween by means of two fastening screws 81, which respectively extend through aligned holes 82*a*, 82*b* formed in the outer clamping plate 77 and carriage side wall 14*a* and then threadedly engage tapped holes 83 formed in the clamping plate 76 (see FIG. 2). As illustrated, the inner clamping plate 76 is normally firmly biased against the inner surface of the carriage side wall 14*a* (see FIG. 1), whereas the outer clamping plate 77 is firmly, but resiliently, biased against the outer, protruding annular side portion of the O-ring 67 (see FIG. 3). A controllable gap 84 (FIG. 3) is thus established between the adjacent surfaces of the clamping plate 77 and the carriage side wall 14*a*.

It should be appreciated, of course, that the width of the O-ring 67 may be chosen, if desired, so as to protrude a short distance outwardly from both major surfaces of the apertured carriage side wall 14*a*. In that event as shown in FIG. 7, the outer periphery of the O-ring 67 could, for example, be formed with a centrally positioned raised annular rib or fin 79 that would seat within an accommodating undercut groove 80 centrally formed in the peripheral edge of the carriage side wall aperture 73. With the O-ring 67 mounted in this manner, a controllable space 84 could be employed between both clamping plates 76, 77 and the respectively adjacent surfaces of the carriage side wall 14*a*.

With the drive nut 20 of FIGS. 2 and 3 constructed and resiliently mounted as described hereinabove, it is readily seen how it may be slightly tilted in any direction relative to the axis of the lead screw 19 (two such directions being indicated by the arcuately directed arrows 85 in FIG. 3), while simultaneously limiting any appreciable axial or radial displacement of the drive nut 20 relative to the lead screw 19 or carriage 14.

The degree of resiliency in the mounting assemblies, of course, can be readily controlled, at least in part, in a number of ways, such as by the size and/or composition of the O-ring 67 employed, and/or by adjustment of the compressive force exerted thereagainst by the clamping plates 76, 77.

In accordance with the principles of the present invention, it has been found very advantageous to make the coupling O-ring 67 out of a material exhibiting a so-called viscoelastic characteristic, i.e., a material basically elastic in nature, but having appreciable viscous properties. Such a material has the ability to absorb energy, such as when subjected to strain in the form of a force exerted thereagainst, without producing appreciable physical deformation, and to thereafter restore itself upon release of the force by dissipating the absorbed (or stored) energy in the form of heat.

It has been found that a material exhibiting a durometer Shore hardness in the range of 60 to 95, with a simultaneous Shore impact resilience by vertical rebound reading not exceeding eight percent, will produce the beneficial results desired. One preferred plastic material found to exhibit the aforementioned desired characteristics is a polyester base urethane sold commercially for end use by Chemi-Flex Products, Inc., Addison, Ill.

With the dimensions of the O-ring 67, as well as the composition thereof, being properly chosen, it has been found that the O-ring 67 can effectively absorb a substantial amount, if not all, of the kinetic energy imparted bounce forces produced by the mass of the carriage 14 as soon as they develop, and immediately thereafter dissipate the resulting absorbed or stored energy in the form of heat with no detrimental effects to the O-ring 67, and with no or minimal transient bounce forces remaining. The importance of eliminating the bounce forces in question as soon as they develop stems from the fact that the rate at which such forces (in the form of energy) must be absorbed by the O-ring 67 (as induced stress) varies approximately directly as the change in velocity of the mass that created such forces.

As previously mentioned, kinetic energy imparted bounce forces have proven particularly troublesome in lead screw-driven printers 10 heretofore whenever there has been backlash, and the carriage 14 has been rapidly stepped (as distinguished from continuously driven) across the width of the platen 42. In such a mode of operation, the often experienced force-induced bouncing of the carriage mass, if not eliminated or compensated for, can be very detrimental. Specifically, such bouncing can not only cause increased wear of the mating lead screw-drive nut threads, but affect the desired speed of travel of the carriage 14 and, thereby, the accurately timed positioning of the print head 12 mounted thereon at each successive dot column position along each print line.

From the foregoing, it becomes readily apparent that whenever a predetermined degree of backlash is built into the lead screw-drive nut assembly so as to minimize wear therebetween, great care must be taken to minimize the kinetic energy-imparted bounce forces established as a result of such backlash. This is particularly true when there is a periodically changing velocity involved in carriage-print head travel, such as in a stepped carriage mode of printer operation.

Advantageously, as a result of the minimal frictional forces that are exerted on the threads of the drive nut 20 when constructed and resiliently mounted as embodied in FIGS. 1–3, the drive nut 20 may advantageously be made out of a suitable plastic material, such as nylon, as well as out of any one of a number of other plastics and conventional metals, with minimal wear being experienced in typical usage. Concomittantly, the carriage 14 may also be readily molded out of a plastic material, such as nylon, with the bore formed in the guide rod support boss 14*b* (see FIG. 1) preferably having a bushing 87 or, such as of brass, secured therewithin for making low friction contact with the associated highly polished guide rod 18. The U-shaped boss 14*c*, preferably also formed as an integral part of the carriage 14, is only employed to lightly support one end of the carriage 14 and print head 12 and, as such, normally does not require a bushing associated therewith for making very close fitting, low friction contact with the associated carriage guide rod 18.

Attention is now directed to FIG. 4 which discloses an alternative resilient mounting assembly 65′. This assembly, with the exception of the resilient O-ring coupling 67′ of circular cross-section employed therein, is essentially identical to the assembly 65 depicted in FIGS. 2 and 3. Like reference numerals are therefore used to identify parts in the embodiment of FIG. 4 that correspond identically with those in the embodiment of FIGS. 2 and 3, with prime reference numerals being used to identify those elements that are modified in some way.

As a result of the circular cross-section of the O-ring 67′ in FIG. 4, the body portion 51*b* of the drive nut 20′ is formed with a semicircular groove 69′. With respect to the carriage sidewall 14*a′*, an undercut groove is formed in the periphery of the aperture 73 thereof, and has a base 71*a′* and a tapered side wall 71*b′*, with the latter terminating at the peripheral edge of the aperture 73. Such an undercut groove allows the O-ring 67′ to be slightly compressed between the tapered wall 71*b′* of the groove and the clamping plate 77 with considerably less deformation that would result with a right-angle undercut groove of the type disclosed in FIG. 3. In all other respects, the resilient mounting assembly 65′ is not only identical to, but functions in the same manner and produces the same advantageous end results as realized with the mounting assembly 65 of FIGS. 2 and 3.

FIGS. 5 and 6 illustrate an alternative drive nut 90 which is also formed with an elongated, cylindrical body 91, one portion thereof having an axially threaded bore 91*a*, with the other remaining portion 91*b* having an unthreaded counter bore 91*b* of larger diameter than that of an associated lead screw 19. To that extent, the drive nut 90 is essentially identical to the drive nut 20 of FIGS. 2 and 3.

The body portion containing the bore 91*a* of the drive nut 90, however, additionally has a plurality (three in the illustrative embodiment) of circumferentially and longitudinally extending slits 93 formed in the side wall of such body portion. These slits 93 extend radially through the thickness of the wall of the body portion containing the bore 91*a* so as to form a plurality of cantilevered, resilient fingers or segments 95*a–c* (see FIG. 6). In certain applications, it may be desirable to extend the slits 93 partly into the body portion containing the unthreaded bore 91*b*, as depicted.

The internally threaded bore 91*a* of the drive nut 90 is normally constructed to be of uniform diameter, with the resilient segments 95*a–c* thereof being compressively spring-biased radially inward by a plurality of so-called garter springs 97 (three shown) coaxially mounted about and partially seated in respectively associated grooves 98 formed in the periphery of the segments 95*a–c*. The internally threaded resilient end of the drive nut 90 may, be constructed or shaped so as to cause the resilient segments or fingers 95*a–c* to exert a compressive, spring-loaded force on the mating threads of the associated lead screw 19 with or without the use of the springs 97, for example, as described in U.S. Pat. No. 3,656,578.

It should be appreciated that the slits 93 are shown as extending longitudinally of the axis of the drive nut 90 only for purposes of illustration. These slits 93, for example, could just as readily be formed into circumferentially spaced spiral slits, for example as shown in U.S. Pat. No. 3,656,358, with the resulting teeth formed therebetween respectively mating with the root areas 57*b* of the threads 57*a–*57*b* in the lead screw 19. Such a segmented resilient drive nut portion, preferably when used in conjunction with garter springs 97 coaxially mounted thereabout, would be equally effective in minimizing backlash between the drive nut 90 and lead screw 19.

As pointed out hereinabove, the degree of force that is exerted to minimize or eliminate backlash will depend to a great extent on the degree of wear that may be tolerated between the mating drive nut 90 and lead screw 19. This, of course, will in turn be dependent primarily on the material chosen, and on the speed and driving torque required for a given application.

With the drive nut 90 constructed and spring loaded in any one of the various ways described hereinabove, the internally threaded fingers or segments 95*a–c* may be formed to effectively exert the desired degree of compressive force against the mating threads 57*a–*57*b* of the lead screw 19 continuously, regardless of tolerance variations or structural misalignment and, thereby, eliminate or at least substantially minimize any backlash.

In summary, two very unique lead screw driven drive nuts 20, 90, and two resilient mountings 65, 65′ applicable for use with either drive nut 20, 90, have been disclosed herein for effectively compensating not only for tolerance variations between the drive nut 20, 90 and lead screw 19, but for any bow in the lead screw 19 and for any axial misalignment between the latter and the carriage guide rods 18. Such compensation is made possible by uniquely mounting the drive nut 20, 90 in a resilient manner on the carriage 14 such that it may acquire a slightly skewed position relative to the axis of the lead screw 19, if required, in order to insure and maintain low friction alignment with the lead screw 19. This, in turn, results in a minimum of wear between such mating parts, and also minimizes the possible occurrence of a binding or jamming condition.

In addition, through the use of a properly chosen resilient O-ring 67, 67′ as the coupling medium, preferably made of a material exhibiting a visco-elastic characteristic, any kinetic energy-imparted bounce forces developed by the carriage and print head mass, particularly when such mass is subjected to variable changes in velocity, are substantially completely absorbed by the O-ring 67, 67′ as soon as they develop and are dissipated in the form of heat. Finally, in applications where no backlash can be tolerated, the drive nut 20, 90 may advantageously be segmented along one internally threaded portion so as to provide a continuous, compressive, spring-biased load against the mating teeth 57*a–*57*b* of the lead screw 19, while still allowing a limited degree of flexure or skewing of the drive nut 20, 90 which may still be required for the reasons pointed out hereinabove.

In view of the foregoing, it is obvious that various modifications may be made to the present illustrative embodiment of the invention, and that a number of alternatives may be provided without departing from the spirit and scope of the invention.

What is claimed is:

1. A lead screw driven, resiliently mounted drive nut and carriage assembly comprising:

a rotatably driven lead screw;

a carriage mountable on and slidably movable along at least one guide rod positioned parallel to said lead screw, said carriage having at least one side wall with an over-sized aperture formed therein and through which said lead screw axially passes without contact;

a drive nut mountable on said driven lead screw for linear translational movement therealong, said drive nut comprising an elongated body having a first portion containing a first threaded bore extending axially a predetermined distance inwardly from one end of said body; a second portion containing a second unthreaded bore extending axially inwardly from the other end of said body, said second unthreaded bore merging with said first threaded bore along an intermediate region of said body, said second unthreaded bore having a diameter larger than the diameter of said lead screw so that said body is slightly skewable relative to the axis of said lead screw; and, a peripheral groove formed near said other body end;

resilient mounting means including a resilient O-ring dimensioned so that an inner annular portion thereof is seated under compressive force in said peripheral groove of said drive nut, said O-ring havng an outer annular portion which is partially seated within an undercut groove formed in the peripheral edge of said aperture in said carriage side wall, said undercut groove being exposed at least to a first side surface of said side wall, and the width of said O-ring being sufficient to that said O-ring protrudes outwardly a predetermined distance from at least said first side wall surface; and first and second clamping plates, each having an over-sized central aperture through which said lead screw axially passes without contact, said clamping plates being connected and adjustably separated on opposite sides of said apertured carriage side wall so as to exert a controllable compressive biasing force against and, thereby, clamp said O-ring to said carriage side wall, with an adjustable space being established between one surface of at least one of said clamping plates and the adjacent surface of said carriage side wall as a result of the outwardly protruding portion of said resilient O-ring, the compressive force exerted on said O-ring by said clamping plates thereby determining, in part, the degree of resiliency exhibited by said O-ring in mounting said drive nut from said other body end, in a cantilevered manner, on said carrige.

2. A lead screw driven, resiliently mounted drive nut and carriage assembly in accordance with claim 1 wherein said first body portion has a plurality of circumferentially spaced slits formed through the wall thereof, said slits extending longitudinally along at least a major part of the axial length of said first body portion so as to form a plurality of cantilevered, resilient fingers which compressively spring bias the internal threads thereof against the mating threads of said lead screw.

3. A lead screw driven resiliently mounted drive nut and carriage assembly in accordance with claim 2 wherein at least one circumferentially disposed groove is formed in the periphery of said resilient fingers near said one body end, with a resilient, coaxially mounted compression spring partially seated therein.

4. A lead screw driven resiliently mounted drive nut and carriage assembly in accordance with claim 1, wherein said O-ring is of circular cross-section.

5. A lead screw driven resiliently mounted drive nut and carriage assembly in accordance with claim 1, wherein said O-ring is of trapezoidal cross-section.

6. A lead screw driven resiliently mounted drive nut and carriage assembly in accordance with claim 1, wherein said O-ring is made of a plastic material exhibiting a viscoelastic characteristic so that any kinetic energy-imparted forces applied thereto by said carriage are at least substantially absorbed and dissipated in the form of heat.

7. A lead screw driven resiliently mounted drive nut and carriage assembly in accordance with claim 6, wherein said O-ring is made out of a plastic material comprising a polyester base urethane, which exhibits a durometer Shore hardness in the range of 60 to 95, and a Shore impact resilience by vertical rebound reading not exceeding eight percent.

8. A lead screw driven resiliently mounted drive nut and carriage assembly in accordance with claim 6, wherein said first and second clamping plates are biased against said apertured carriage side wall and said resilient O-ring respectively by means of adjustable threaded fastening members.

9. A lead screw driven resiliently mounted drive nut and carriage assembly in accordance with claim 8, wherein the threads of said drive nut are dimensioned relative to the threads of said lead screw so as to establish a predetermined degree of backlash therebetween.

10. A lead screw driven, resiliently mounted drive nut and carriage assembly in accordance with claim 8, wherein said first body portion has a plurality of circumferentially spaced slits formed therethrough, said slits extending longitudinally along at least a major part of the axial length of said first portion so as to form a plurality of cantilevered, resilient fingers which compressively spring bias the internal threads thereof against the mating threads of the lead screw, and wherein at least one circumferentially disposed groove is formed in the periphery of said fingers near said one body end, with a resilient, coaxially mounted compression spring partially seated therein.

11. In a high speed printer wherein a print head is reciprocably driven back and forth along a linear path in close proximity to a print medium which engages and is driven by a rotatably controlled platen, and wherein a reversible inked ribbon interposed between the print head and the print medium transfers character images to and imprints them on said medium in a line-by-line manner while the print medium is drawn taut against the platen, said combination further comprising:

a rotatably driven lead screw;

guide means including at least one elongated guide rod;

a carriage mountable on and slidably movable along at least said one guide rod positioned parallel to said lead screw, said carriage having at least one side wall with an over-sized aperture formed therein and through which said lead screw axially passes without contact;

a drive nut mountable on said driven lead screw for linear translational movement therealong, said drive nut comprising an elongated body portion having a first threaded bore extending axially a predetermined distance inwardly from one end thereof, and a second unthreaded bore extending axially inwardly from the other end thereof and merging with said first threaded bore along an intermediate region of said drive nut, said second unthreaded bore having a diameter larger than the diameter of said lead screw so that said body is skewable slightly relative to the axis of said lead screw, and a peripheral groove formed near said other end of said drive nut;

resilient mounting means including a resilient O-ring dimensioned so that an inner annular portion thereof is seated under compressive force in said peripheral groove of said drive nut, said O-ring having an outer annular portion which is partially seated within an undercut groove formed in the peripheral edge of said aperture in said carriage side wall, said undercut groove being exposed at least to one side surface of said side wall, and the width of said O-ring being sufficient so that said O-ring protrudes outwardly a predetermined distance from said one side wall surface; and first and second clamping plates, each having an over-sized central aperture through which said lead screw axially passes without contact, said first clamping plate having one side surface thereof biased firmly against an adjacent side surface of said apertured carriage side wall, with an annular portion of one side surface of said second clamping plate, surrounding said aperture therein, being resiliently biased in an adjustable manner against at least an annular portion of an outwardly protruding side surface of said O-ring so as to establish a controllable space therebetween, while resiliently securing said O-ring to said carriage side wall, the compressive force exerted on said O-ring by said clamping plates thereby determining, in part, the degree of resiliency exhibited by said O-ring in mounting said drive nut from said other body end, in a cantilevered manner, on said carriage, the axis of said drive nut being thereby slightly skewable relative to the axis of said lead screw, the O-ring minimizing any relative axial or radial displacement between said drive nut and lead screw axes, as well as between said drive nut and carriage side wall, and wherein said O-ring is made out of a plastic material exhibiting a viscoelastic characteristic so that any kinetic energy-imparted forces applied thereto by said carriage are at least substantially absorbed and dissipated in the form of heat.

12. A high speed printer in accordance with claim 11, wherein said resilient O-ring is made out of a plastic material comprising a polyester base urethane, and wherein said first and second clamping plates are biased against said apertured carriage side wall and said resilient O-ring respectively by means of adjustable threaded fastening members, and wherein the threads of said drive nut are dimensioned relative to the threads of said lead screw so as to establish a predetermined degree of backlash therebetween.

13. In a high speed printer in accordance with claim 11, said body portion of said drive nut further including a plurality of circumferentially spaced slits formed therethrough into said first threaded bore, with said slits extending longitudinally from said one end along at least a major part of the axial length of said first threaded bore so as to form a plurality of cantilevered, resilient fingers which compressibly spring bias the internal threads thereof against the mating threads of said lead screw, and wherein at least one circumferentially disposed groove is formed in the periphery of said fingers near said one end, with a resilient, coaxially mounted compression spring being partially seated therein.

14. A lead screw driven, resiliently mounted drive nut and carriage assembly comprising:

a rotatably driven lead screw;

a carriage mountable on and slidably movable along at least one guide rod positioned parallel to said lead screw, said carriage having at least one side wall with an over-sized aperture formed therein and through which said lead screw axially passes;

a drive nut mountable on said driven lead screw for linear translational movement therealong, said drive nut comprising an elongated body portion having a first threaded bore extending axially a predetermined distance inwardly from one end thereof, and a second unthreaded bore extending axially inwardly from the other end thereof and merging with said first threaded bore along an intermediate region of said drive nut, said second unthreaded bore having a diameter larger than the diameter of said lead screw so as to define an annular space therebetween, and a peripheral groove formed near said other end of said drive nut; and resilient mounting means including a resilient O-ring dimensioned so that an inner annular portion thereof is seated under compressive force in said peripheral groove of said drive nut, said O-ring having an outer annular portion which is partially seated within an undercut groove formed in the peripheral edge of said aperture in said carriage side wall, the width of said O-ring being dimensioned so as to protrude outwardly a predetermined distance from at least one surface of said carriage side wall, and said mounting means further including:

means for compressively clamping said O-ring to said carriage side wall such that said O-ring resiliently mounts said drive nut from said other body end, in a cantilevered manner, on said carriage, the axis of said drive nut thereby slightly skewable relative to the axis of said lead screw, the O-ring minimizing any relative axial or radial displacement therebetween, as well as between said drive nut and carriage.

15. A lead screw driven resiliently mounted drive nut and carriage assembly in accordance with claim 14 wherein said O-ring is made of a plastic material exhibiting a viscoelastic characteristic, and further exhibiting a durometer Shore hardness in the range of 60 to 95, and a Shore impact resilience by vertical rebound reading not exceeding eight percent, which results in any kinetic energy-imparted forces applied thereto by said carriage being at least substantially absorbed and dissipated in the form of heat.

* * * * *